US008357031B2

(12) United States Patent
Dinicolas

(10) Patent No.: US 8,357,031 B2
(45) Date of Patent: Jan. 22, 2013

(54) OUTDOOR AIR CONDITIONER COVER ASSEMBLY

(76) Inventor: Michael Dinicolas, Sayreville, NJ (US)

( * ) Notice: Subject to any disclaimer, the term of this patent is extended or adjusted under 35 U.S.C. 154(b) by 501 days.

(21) Appl. No.: 12/563,561

(22) Filed: Sep. 21, 2009

(65) Prior Publication Data

US 2010/0081371 A1 Apr. 1, 2010

Related U.S. Application Data

(60) Provisional application No. 61/101,109, filed on Sep. 29, 2008.

(51) Int. Cl.
*F24F 7/00* (2006.01)

(52) U.S. Cl. ..... 454/201; 454/202

(58) Field of Classification Search ..... 454/275, 454/201, 202, 203, 205, 196, 218, 210
See application file for complete search history.

(56) References Cited

U.S. PATENT DOCUMENTS 1,227,152 A * 5/1917 Johanson ..... 52/67
1,936,875 A * 11/1933 Hirschman ..... 392/363
1,946,887 A * 2/1934 Sipe ..... 454/205
2,010,808 A * 8/1935 Braine ..... 454/205
2,010,809 A * 8/1935 Braine ..... 454/205
2,051,613 A * 8/1936 MacLeod ..... 454/206
2,227,990 A * 1/1941 Zelt ..... 454/237
2,559,495 A * 7/1951 Calkins ..... 454/205
2,691,336 A * 10/1954 Nash ..... 454/210
2,705,990 A * 4/1955 Miller ..... 150/165
2,780,982 A * 2/1957 Malone et al. ..... 454/202
2,885,944 A * 5/1959 Bates ..... 454/366
3,011,424 A * 12/1961 Kohnen ..... 454/204
3,137,226 A * 6/1964 Pietsch ..... 454/203
3,426,667 A * 2/1969 Johnson ..... 454/275
3,500,738 A * 3/1970 Wenig ..... 454/202
3,584,134 A * 6/1971 Nichols et al. ..... 174/383
3,699,873 A * 10/1972 Irvin ..... 454/319
3,831,321 A 8/1974 Johnson
3,974,661 A * 8/1976 Ferdelman et al. ..... 62/262
4,019,556 A 4/1977 Selger
D246,379 S * 11/1977 Mueller ..... D23/354
4,202,389 A 5/1980 Ewald
4,308,905 A 1/1982 Gallagher
4,332,114 A * 6/1982 Goebel et al. ..... 62/262
4,389,827 A 6/1983 Van Valkenburg
4,572,059 A * 2/1986 Ramsay ..... 454/367
4,625,784 A 12/1986 Boroson
4,686,893 A 8/1987 Jinkins
4,759,194 A 7/1988 Shapiro
(Continued)

*Primary Examiner* — Steven B McAllister
*Assistant Examiner* — Samantha Miller
(74) *Attorney, Agent, or Firm* — Berenato & White, LLC

(57) ABSTRACT

This invention is a modular all-season air conditioner cover (for ground supported or window supported A/C units). The cover includes fixed side wall intake air louvers interleaved around the main cover assembly side walls to shield the air condition unit from the outdoor elements without restricting intake air flow toward the A/C coils. In each embodiment of the invention, a plurality of interleaved exhaust face louvers having overlapping depending edges are included, that are both used to channel rain water away from the air condition unit and are free to articulate to and away from the A/C fan air exit face grate and the adjacent surfaces of the main cover assembly to which they are attached. The articulated louvers are moved from a resting to an open position by air pressure from the fan driven cooling air being drawn through the A/C unit coils. In an alternate version, an additional top face grate is attached above the top face of the exhaust air actuated louvers to keep debris from obstructing their articulation. In order to speed the installation and removal of the present invention, magnets for holding the cover in position are affixed to slots in the main cover assembly.

1 Claim, 6 Drawing Sheets

U.S. PATENT DOCUMENTS

| | | | | | |
|---|---|---|---|---|---|
| 4,788,805 | A | | 12/1988 | Shaw | |
| 4,953,328 | A | | 9/1990 | Sewell et al. | |
| 5,097,678 | A | | 3/1992 | Aubuchon | |
| 5,125,197 | A | | 6/1992 | Fuchs | |
| 5,184,475 | A | * | 2/1993 | Matsumi | 62/262 |
| 5,193,355 | A | * | 3/1993 | Matsumi | 62/262 |
| 5,253,485 | A | * | 10/1993 | Kennedy et al. | 62/262 |
| 5,294,195 | A | | 3/1994 | Amr et al. | |
| 5,916,023 | A | * | 6/1999 | Meyer | 454/359 |
| 6,158,175 | A | | 12/2000 | Carter | |
| 6,397,617 | B1 | | 6/2002 | Johnson | |
| 6,430,954 | B1 | | 8/2002 | Smith | |
| 6,708,514 | B1 | | 3/2004 | Miller | |
| 7,140,194 | B1 | | 11/2006 | Miller | |
| 7,328,589 | B2 | | 2/2008 | Boone | |
| 7,387,654 | B1 | * | 6/2008 | Byers | 55/385.1 |
| 2002/0171337 | A1 | | 11/2002 | Moretti | |
| 2007/0011930 | A1 | | 1/2007 | Yarmosh | |
| 2008/0108294 | A1 | | 5/2008 | Reed | |

* cited by examiner

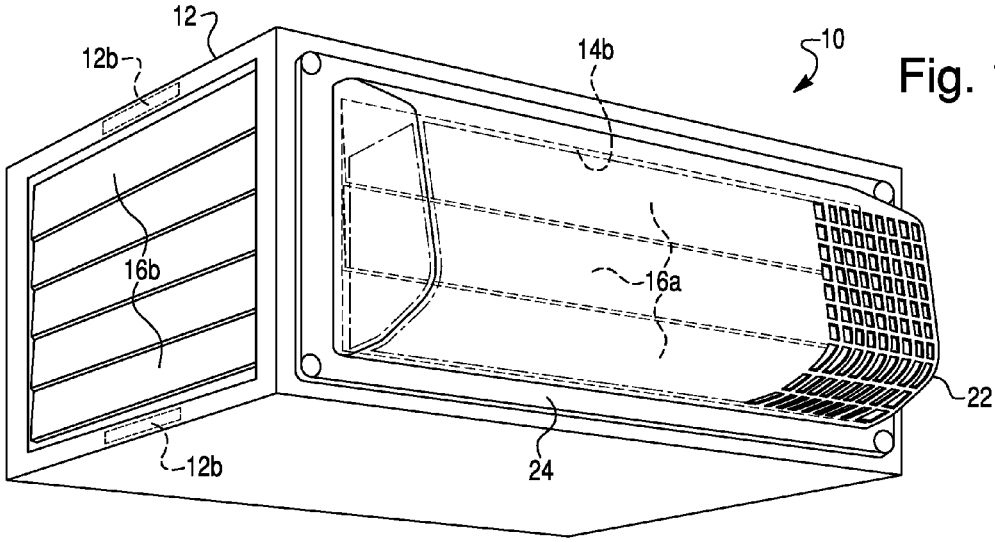
Fig. 1
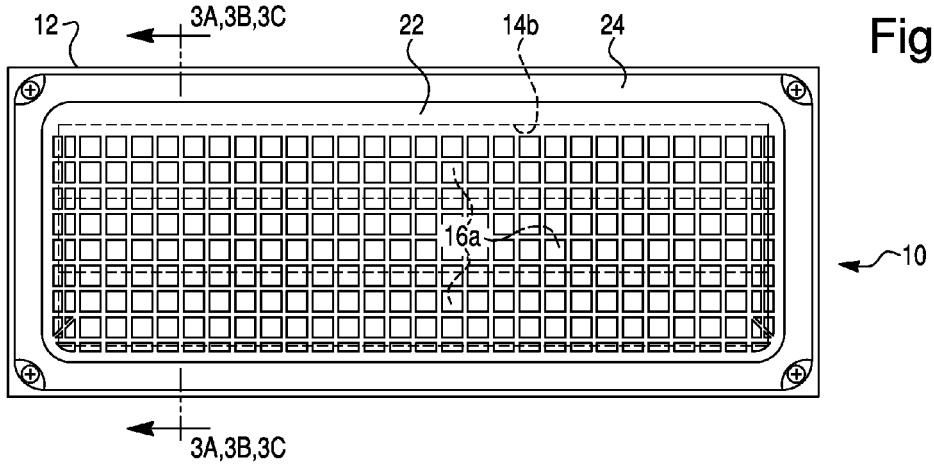
Fig. 2
Fig. 3A
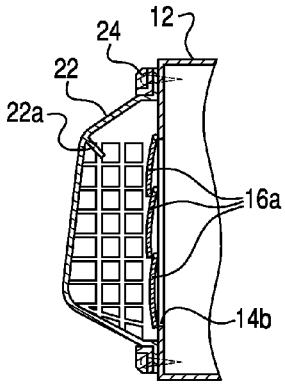
Fig. 3B
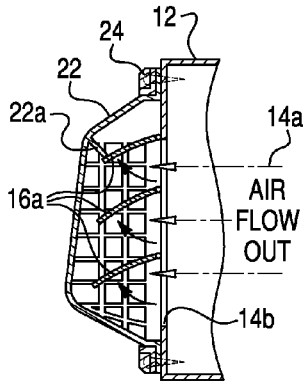
Fig. 3C
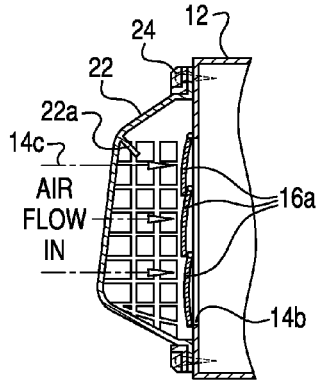

OUTDOOR AIR CONDITIONER COVER ASSEMBLY

This application claims the benefit of U.S. Provisional Application Ser. No. 61/101,109, filed Sep. 29, 2008.

BACKGROUND OF THE INVENTION

The present invention generally relates to a weather resistant air conditioner cover that shields an air condition unit (ground or window unit) from humidity, sun, rain, melting snow, melting ice and debris. More particularly, the present invention relates to an air conditioner cover top face and assembled sides that are modular and assemble on site.

DESCRIPTION OF THE PRIOR ART

The problem: known seasonal air condition unit covers, used either residentially or commercially, restrict and obstruct the intake and exhaust air flows while providing shielding from one or all of the following outdoor elements: the humidity, sun, rain, melting snow, melting ice and debris. Current air condition unit covers that do not obstruct or restrict the intake and exhaust air flows can only provide adequate protection from up to three of the following elements: humidity, sun, rain, or debris. In addition, an inconvenient situation arises after the installation of a seasonal semi-permanent cover, that restricts either/both intake or/and exhaust air flows, and an air conditioner unit's fan is unintentionally activated. The obstructed intake or exhaust air flows lead to the rapid overheating (of the compressor) and eventual failure of an outdoor air condition unit.

SUMMARY OF THE INVENTION

The primary object of the present invention is to provide an air conditioner cover that can continuously protect an air condition unit from outdoor elements regardless of the unit's mode of operation. Another object is to provide an outdoor cover that directs exhaust air flow in a predetermined direction through a top face grate to remove debris. An additional object of the invention is to provide an outdoor cover that channels rain, melting snow, melting ice, condensation, and the like away from the air condition unit by utilizing a plurality of interleaved air-pressure driven articulating louvers with depending trailing edges that overlap the rotating leading edges of adjacent louvers when not in an activated position. A further object is to provide a year-round cover that does not inhibit the intake and exhaust flows of an air condition unit. A further object still is to provide an outdoor cover that is simple to size, assemble and install.

The above objects are achieved by the present invention which utilizes a plurality of fixed intake air louvers around the side walls of the enclosed A/C unit along with interleaved louvers overlying the exhaust face of the air conditioner unit that are free to articulate between open and closed positions by virtue of driven air from the air condition unit fan urging the louvers into an open position when activated.

In a typical rectangular embodiment of the present invention, the outdoor cover is made up of the following elements: (1) a main top cover assembly grate, generally matching the top shape and exterior contour of the outdoor a/c unit, equipped with support beams which form passageways (a suspended grate), respectively, that are complimentary to the air condition unit exhaust vent; (2) a top face frame equipped with articulating, lapped, exhaust face louvers, positioned immediately beneath the main top cover assembly; and, (3) side wall louvers, which may be slightly rounded along the units' widest longitudinal face, connected edge to edge to one another, in a snap-fit arrangement, so as to surround the a/c unit side elements.

Generally speaking, these elements are related as follows: for the purpose of the directing exhaust air flow and diverting rain, a plurality of exhaust face louvers with their depending edges interleaved extend away from a side wall and pivotally attach at opposing longitudinal ends to support points on the upper surface of the rectangular main cover assembly's top face frame; for the purpose of shielding the top of the air condition unit from debris (in the case of an upwardly exhausting ground unit), a top face grate may be attached to the surface of the upper face of the rectangular main cover assembly and is aligned with the air condition units exhaust vent profile; and, for the purpose of shielding the sides of the air condition unit from debris, the side wall louvers are interleaved and attached to the rectangular main cover assembly.

Further, this invention can also have one or more of the following: (1) a circular or oval main cover assembly shape, which forms a cylinder with support beams perpendicular along the outermost edges of the circular top and bottom faces which have a circular passageways at either face that are complimentary to the air condition unit exhaust vent and air condition unit base profiles, respectively.

BRIEF DESCRIPTION OF THE DRAWINGS

FIG. 1 shows a window a/c unit equipped with a cover according to the present invention.

FIG. 2 shows a front plan view of the cover shown in FIG. 1.

FIG. 3A shows a partial sectional view of the cover shown in FIG. 2 in a zero air flow configuration.

FIG. 3B shows the same partial section as in FIG. 3A but in an exhaust fan activated configuration.

FIG. 3C shows the same partial section as in FIG. 3A but with the louvers closed and resisting penetrating airflow.

DETAILED DESCRIPTION

Figure 6:
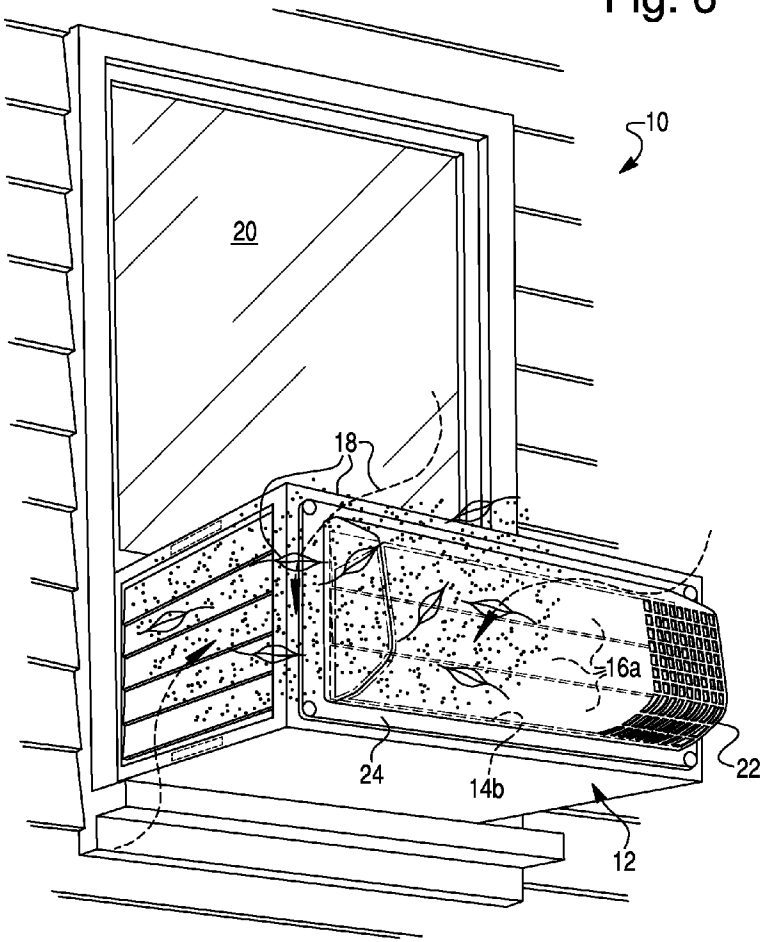
FIG. 6 shows the FIG. 1 embodiment in use, resisting the effects of weather.

With reference to the drawings Figures: The invention 10, shown as cover 12 and as used and applied for a window 20 mounted a/c unit is generally shown in FIGS. 1-3, and 6. The major components of the cover 12 are the exhaust cover member 24, and the side cover elements including fixed louvers 16*b*. The sides and exhaust cover are attached to the a/c unit using magnets 12*b* integrated into the respective side and exhaust cover elements. When air currents 14*a* from an activated a/c fan draws air in through side louvers 16*b*, the air is passed outwardly through rotating vanes 16*a* mounted to the front cover 24 frame opening 14*b* as shown in FIG. 3B. The rotating louvers are protected by a suspended grate or grill member 22, and the vanes 16*a* are stopped from excessive rotation by interior stop element 22*a*. When the fan is off, the louvers return to a resting interleaved nested position as shown in 3A and 3C. In this way, regardless of weather, FIG. 6, the window a/c unit is protected, and the weather outside is prevented from making its way through the deactivated a/c unit and into the interior of the home.

The cover 12 may include separate side elements individually mounted to the underlying a/c unit using magnets (or other suitable fastener, i.e., double sided foam tape, small sheet metal screws, rivets, etc.). Alternatively, the cover may be a fully integrated 4 or 5 sided box (the underside being optionally left out, 4 sided, or included, 5 sided) and attached likewise using magnets, fasteners, tape, etc. The side panels for the window unit may also, in some instances, be created without vents owing to the lack of corresponding vents on the covered window a/c unit. In such cases, the cover may have vent-less side panels, with venting provided only on the top/bottom, or wherever the corresponding air intake(s) is on the covered a/c window unit. The rotating vane end cover 24 is unchanged when used in combination with the vent-less side panels.

Figure 4:
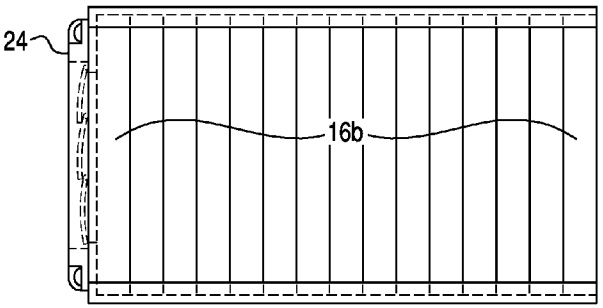
FIG. 4 shows a side plan view of a side panel for the embodiment of the invention shown in FIG. 7.
Figure 5:
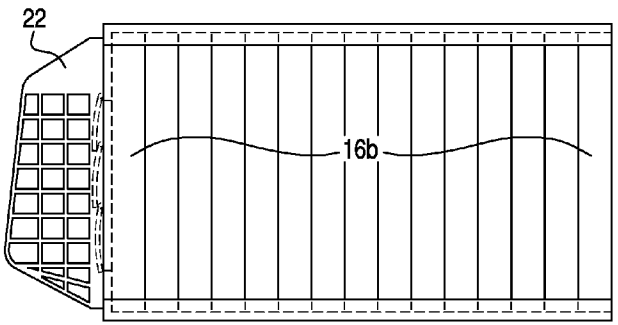
FIG. 5 shows a side plan view of a side panel as in FIG. 4, but with the top face grate in place.
Figure 7:
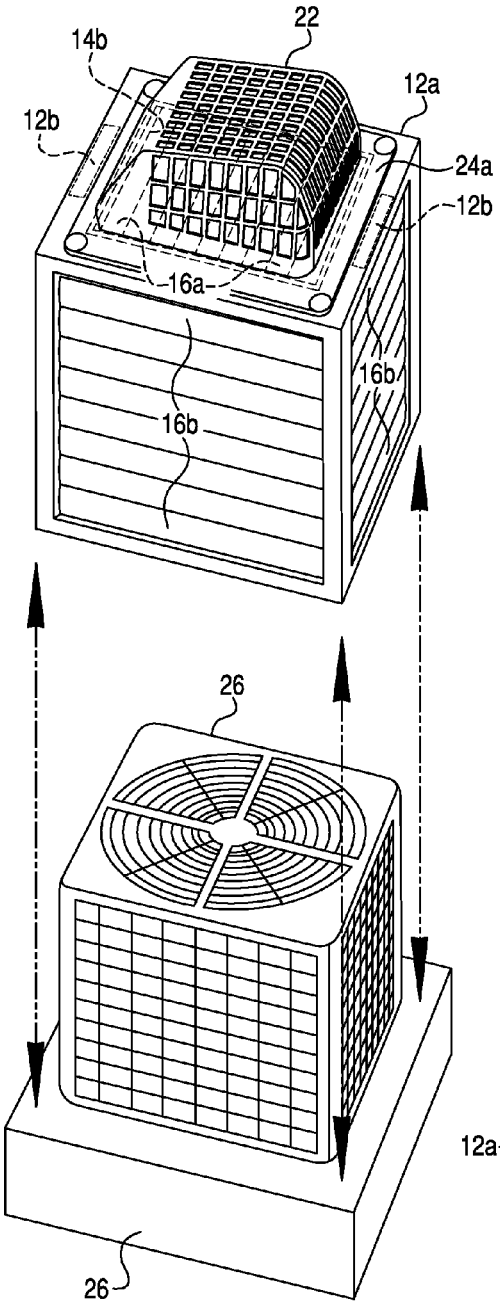
FIG. 7 shows a ground mounted a/c unit cover telescoping over a ground mounted a/c outdoor unit.
Figure 8:
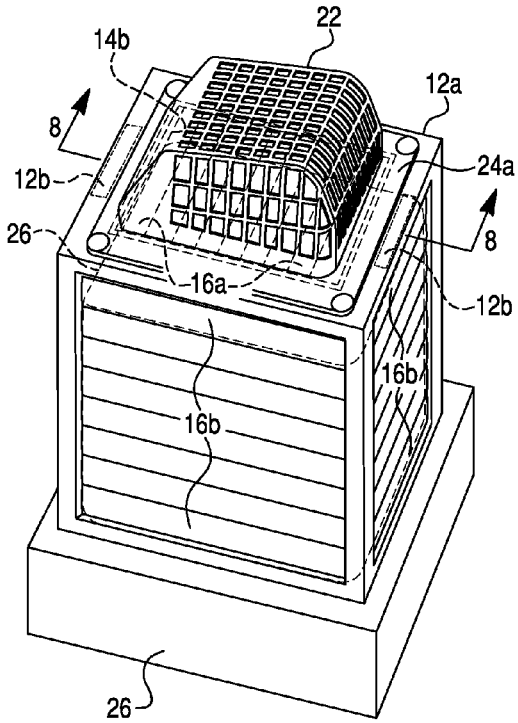
FIG. 8 shows the FIG. 7 embodiment in place.
Figure 8A:
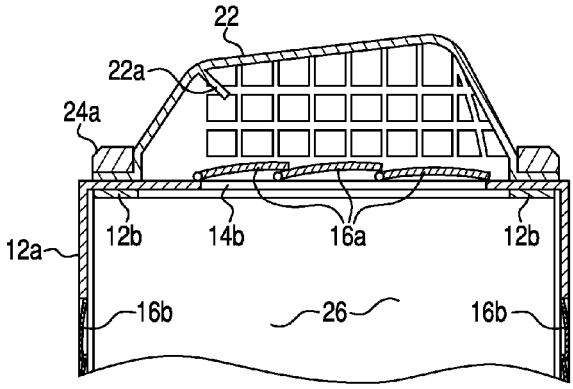
FIG. 8A is a partial sectional view of the FIG. 8 embodiment.
Figure 10:
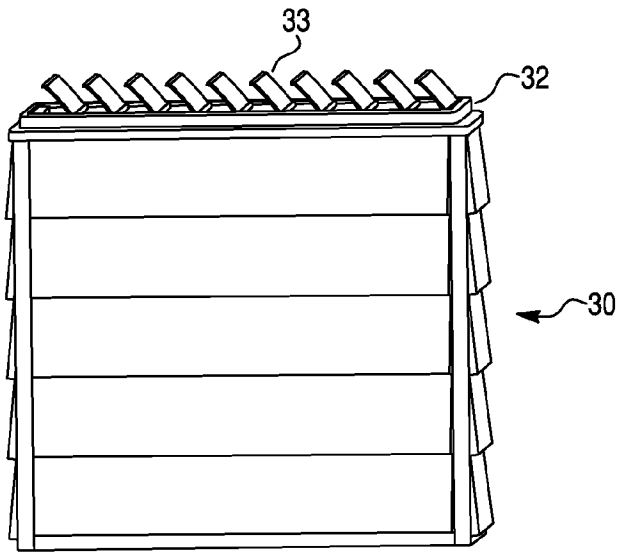
FIG. 10 shows a side perspective view of the a/c cover shown in FIG. 9.
Figure 9:
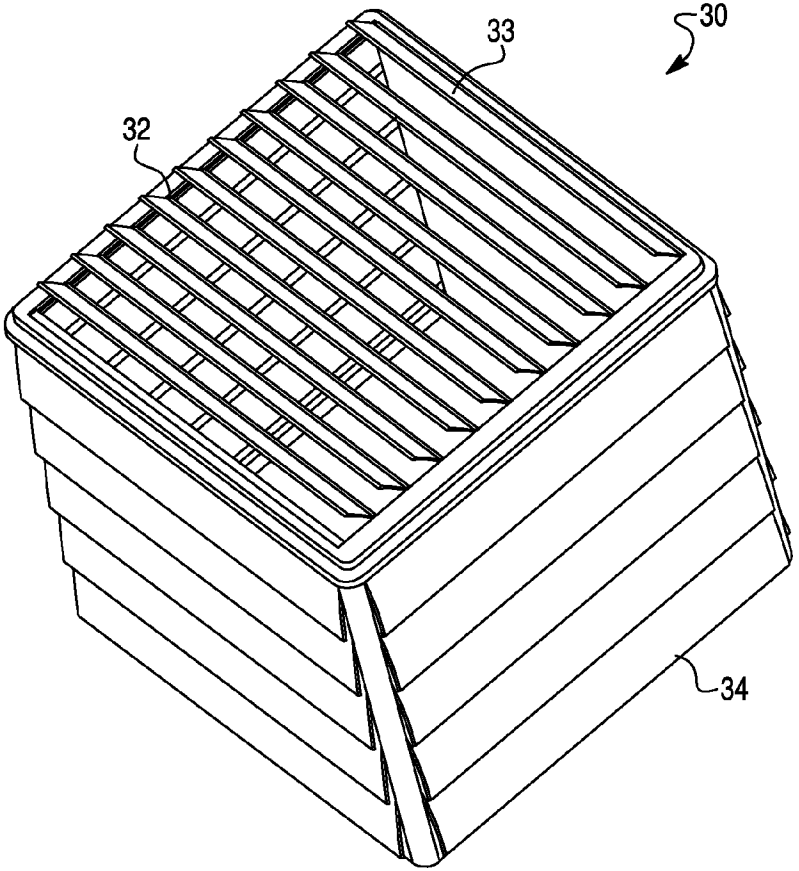
FIG. 9 shows a perspective view of a modular outdoor a/c cover according to the present invention.
Figure 12:
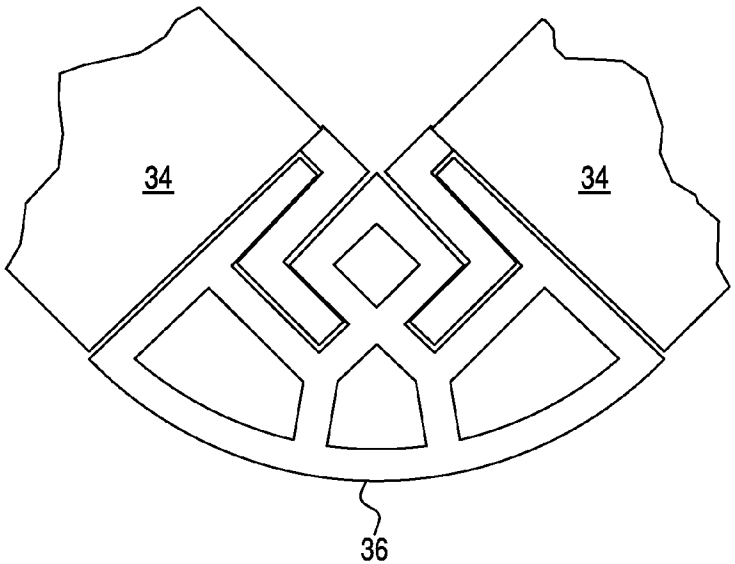
FIG. 12 shows a close-up view of the end of the connecting extrusion element for relating respective side panels of the cover shown in FIG. 9.
Figure 11:
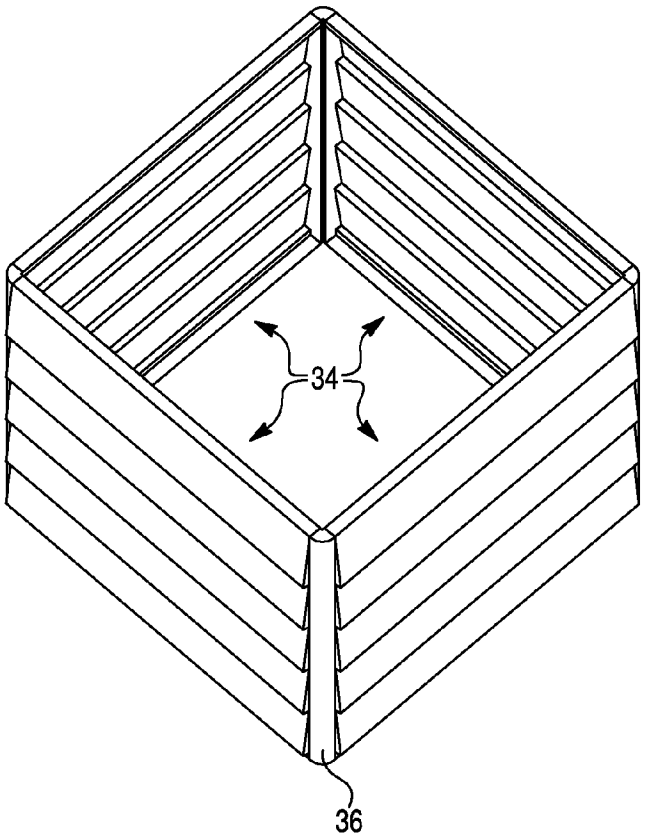
FIG. 11 shows a perspective view of assembled side panels of the FIG. 10 cover.

The ground supported a/c cover is shown in FIGS. 4, 5 (side elements), FIGS. 7-14. With reference to FIGS. 4, 5, and 7-8A: The cover 12*a* includes a top frame 24*a* including a suspended grate or grill 22. The rotatably mounted louvers 16*a* are positioned immediately beneath the grill 22, and rotate to a limit stop 22*a*. The top 24*a* is attached to (or fully integrated with) depending side members including fixed louvers 16*b* and collectively, the entire cover assembly (top and sides) telescopes over the a/c unit 26 mounted to its associated base member. The cover can include suitable fasteners, for example magnets 12*b*, that hold the cover removably in position on the fan equipped top of a typical outdoor ground supported a/c unit 26.

A modular version of the cover is shown in FIGS. 9-14. In this version 30, the cover is assembled from modular top 32 and side members 34. The top 32 may be used on its own as just a top cover, attached with magnets, or other suitable fasteners (screws, double sided tape, etc.) to the outdoor a/c unit 26 shell. The top cover 32 is shown without an overlying grill 22, so that the rotating and lapped vanes 33 are fully exposed and operation thereof can be seen.

More advantageously, however, the top cover 32 will be used in conjunction with surrounding snap together extrusion fitted side elements 34. These are fixed louver 35 side elements that are connected one to the other along side frame members 37 using extrusions 36. In this way, the side elements can remain in place when the a/c unit fan is serviced, or can be removed if greater access is required. Ideally, all four sides of an a/c unit are surrounded by the fixed louver side elements 34, but this may not be possible in all instances, i.e, critical control panel access or hook up elements for the outdoor a/c unit itself may prevent 360 degree protection. In such cases, the side elements 34 (ideally a light plastic, with sufficient softness to be cut and trimmed on site) can be trimmed to avoid high and low pressure a/c connections as well as the electrical service lines. Notches and grooves can be cut into the panels 34 with roofing shears or using a light duty hand saw (manual or electric) and the side panels may be assembled using the connecting extrusions 36 and placed around the unit 26.

Figure 14:
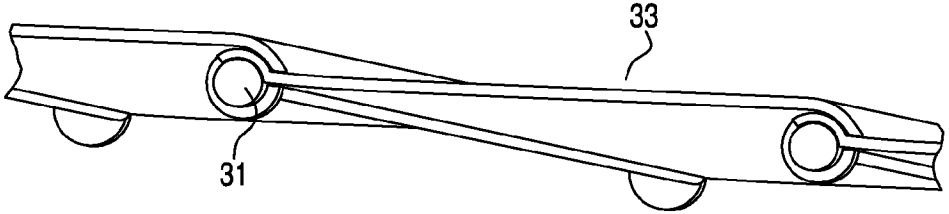
FIG. 14 is a perspective view of a pair of rotating lapped top frame louver elements.
Figure 13:
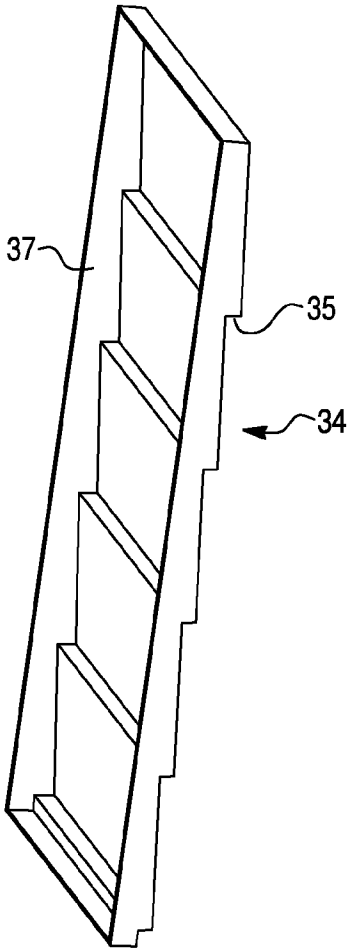
FIG. 13 is a perspective view of a side panel for the cover shown in FIG. 9.

The side louvers 35 are fixed, but are sufficiently open to enable air to pass adequately to the a/c unit coils. The rotating louvers 33 are linked one to the other as shown in FIG. 14 to allow for close cooperation when shut. In this way, the interleaving enables rain and melting snow to drain to one side or the others of the covered a/c unit 26 and not collect above the fan. The cover shields the air condition unit from UV deterioration of wire insulation, corrosion, etc. In addition, the cover may be offered in colors that more closely match or complement the nearby house or other structure. The cover may also be painted using a suitable paint, likewise to match the house/fence/etc. nearby.

It should further be noted that: (a) a rectangular or circular main cover assembly 10 can be made out of various materials, such as but not limited to aluminum (or any other metal or metal alloy), wood, plastic (or any other polymer or polymer combination), or any other sufficiently rigid and durable material, but plastic is preferable; (b) the side wall 16*b* and top face louvers 16*a* can be made out of various materials, such as but not limited to aluminum (or any other metal or metal alloy), wood, plastic (or any other polymer or polymer combination), or any other sufficiently rigid and durable material, but plastic is preferable; (c) a top face grate 22 can be made out of various materials, such as but not limited to aluminum (or any other metal or metal alloy), wood, plastic (or any other polymer or polymer combination), or any other sufficiently rigid and durable material, but plastic is preferable.

The various connection means between rectangular\circular main cover assembly frame 14, 24, side wall louvers 16*b*, top face louvers 16*a*, top face grate 22, and air condition unit base 26 can be described as follows: rectangular/circular cover assembly frame 14, 24 can be secured to the air condition unit base 26 by various means, such as but not limited to screws, nuts and bolts, rivets, bolts and pins, threaded bolts, nails, magnets, soldering, epoxy (or any other adhesive or adhesive combination), but magnets are preferable; the top face grate 22 can be attached to the rectangular\circular main cover frame assembly by various means, such as but not limited to screws, nuts and bolts, rivets, bolts and pins, threaded bolts, nails, magnets, soldering, epoxy (or any other adhesive or adhesive combination), but a weather resistant snap together interlock is preferable; the top face louvers 16*a* can be attached to the rectangular\circular main cover assembly by various means, such as but not limited to screws, nuts and bolts, rivets, bolts and pins, threaded bolts, nails, magnets, soldering, epoxy (or any other adhesive or adhesive combination), but bolts and pins are preferable; the side wall 16*b* louvers can be attached to the rectangular\circular main cover assembly by various means, such as but not limited to screws, nuts and bolts, rivets, bolts and pins, threaded bolts, nails, magnets, soldering, epoxy (or any other adhesive or adhesive combination), but a snap together weather resistant interlock is preferable.

While the present invention has been described in terms of specific embodiments, it is to be understood that the invention is not limited to these disclosed embodiments. This invention may be embodied in many different forms and should not be construed as limited to the embodiments set forth herein; rather, these embodiments are provided by way of illustration only and so that this disclosure will be thorough, complete and will fully convey the full scope of the invention to those skilled in the art. Indeed, many modifications and other embodiments of the invention will come to mind of those skilled in the art to which this invention pertains, and which are intended to be and are covered by both this disclosure and the drawings.

The invention claimed is:

1. A window mounted a/c unit cover, comprising:

a cover element for affixing to a fan equipped portion of said a/c unit, said cover element including a surrounding frame having rotatably mounted, interleaved, vanes attached thereto across an inner perimeter of said frame, and capable of being forced into an open position by air currents being forced through said a/c unit by said fan, and further including an overlying fixed grill sized to enable said vanes to fully extend to a motion stop affixed beneath said grill, said stop projecting from said grill toward said rotatably mounted, interleaved vanes, wherein said unit cover further comprises depending side cover elements having fixed louvers extending across the face thereof, said side cover elements being related edge wise one to the other and presenting an open bottom to telescope over an a/c unit to be covered and an open top that can be attached to an outer perimeter of said cover element surrounding frame, said side cover elements edgewise relation uses an extruded member to connect said side cover elements, and wherein said cover is affixed to said fan equipped portion using magnetic fasteners.

* * * * *